United States Patent [19]

Kumagai et al.

[11] Patent Number: 4,922,865

[45] Date of Patent: May 8, 1990

[54] TWO-STROKE-CYCLE UNIFLOW SPARK-IGNITION ENGINE

[75] Inventors: Seiichiro Kumagai, Tokyo; Michikata Kono, Hachioji; Masakazu Okai, Kanagawa; Hisashi Inaga, Tokyo, all of Japan

[73] Assignee: Kioritz Corporation, Tokyo, Japan

[21] Appl. No.: 313,057

[22] Filed: Feb. 16, 1989

[30] Foreign Application Priority Data

Mar. 9, 1988 [JP] Japan ..... 63-53573

[51] Int. Cl.[5] ..... F02B 15/00

[52] U.S. Cl. ..... 123/65 VC; 123/73 C; 123/306

[58] Field of Search ..... 123/65 VC, 73 PP, 65 R, 123/299, 65 A, 306, 308, 65 R, 73 R, 73 C

[56] References Cited

U.S. PATENT DOCUMENTS

| | | | |
|---|---|---|---|
| 1,540,286 | 6/1925 | Roberts . | |
| 2,170,477 | 8/1939 | Lemasson | 123/65 BA |
| 2,188,368 | 1/1940 | McCarthy | 123/65 VC |
| 2,255,424 | 9/1941 | Jandasek | 123/65 BA |
| 4,289,094 | 9/1981 | Tanahashi | 123/73 AF |
| 4,312,305 | 1/1982 | Noguchi et al. | 123/65 PD |
| 4,317,432 | 3/1982 | Noguchi et al. | 123/65 A |
| 4,332,229 | 6/1982 | Schuit | 123/65 B |
| 4,682,570 | 7/1987 | Velencei | 123/73 PP |
| 4,719,880 | 1/1988 | Schlunke et al. | 123/65 WA |

FOREIGN PATENT DOCUMENTS

| | | | |
|---|---|---|---|
| 96732 | 10/1923 | Fed. Rep. of Germany | 123/65 VC |
| 833366 | 10/1938 | France | 123/65 VC |
| 87/07325 | 12/1987 | PCT Int'l Appl. . | |
| 120251 | 10/1918 | United Kingdom . | |
| 198422 | 6/1923 | United Kingdom . | |
| 375116 | 6/1932 | United Kingdom | 123/65 VC |
| 379561 | 9/1932 | United Kingdom | 123/65 VC |

*Primary Examiner*—David A. Okonsky

*Attorney, Agent, or Firm*—Browdy and Neimark

[57] ABSTRACT

A two-stroke-cycle uniflow spark-ignition engine generates power by pressurizing fluid introduced into a crank chamber within the crank chamber with a piston as it moves toward its bottom dead center, feeding the pressurized fluid to an annular scavenging chamber provided on the entire periphery of a cylinder where it accumulates, and discharging the fluid in the annular scavenging chamber into a cylinder chamber provided above the piston from a plurality of scavenging ports which are opened at the end of the descending stroke of the piston as a scavenging fluid in the form of a swirling uniflow.

3 Claims, 5 Drawing Sheets

TWO-STROKE-CYCLE UNIFLOW SPARK-IGNITION ENGINE

BACKGROUND OF THE INVENTION

1. Field of the Invention

The present invention relates to a two-stroke-cycle uniflow spark-ignition engine which is designed to generate power by supplying into a cylinder a scavenging fluid which has been precompressed in a crank chamber and which consists of an air-fuel mixture or air, while injecting fuel into the cylinder, if the scavenging fluid consists of the air, and by compressing the air-fuel mixture by means of a piston and ingiting the compressed air-fuel mixture by means of a spark, an exhaust gas being expelled through an exhaust valve provided in a cylinder head.

2. Description of the Related Art:

Conventional two-stroke-cycle spark-ingition engines are based on the so-called three-port type engine developed by Day, J., a British engineer, in 1891. In this two-stroke-cycle spark-ignition engine, the conversion of the energy provided by a fuel into useful power takes place as follows: An air-fuel mixture which is supplied from an inlet port of a cylinder is precompressed in a crank chamber, and the precompressed air-fuel mixture is introduced into the cylinder through a scavenging passage from a scavenging port which is opened to a cylinder surface against which a piston slides. The air-fuel mixture so supplied is further compressed by the piston in the cylinder. Upon ignition of this fuel-air mixture, it undergoes combustion and thereby generates power. Exhaust gas is expelled through an exhaust port provided in the surface of the cylinder against which the piston slides.

Suitable scavenging methods for such a conventional two-stroke-cycle spark-ignition engine include cross-flow scavenging in which a scavenging port and an exhaust port are disposed in the cylinder in opposed relation with each other, and in which a piston head is provided with a protrusion to prevent the scavenging fluid from directly flowing into the exhaust port; and loop scavenging in which a plurality of scavenging ports are disposed symmetrically with respect to the exhaust port. The engine performance has been improved in both of these scavenging systems so that less fuel is required to operate the engine for a given load. However, it seems that the possibility for additional research has reached its limit.

As regards combustion, with any of the above-described scavenging systems, the rate of dilution of scavenging air (an air-fuel mixture) with residual combustion gas is far higher than that obtained in a normal four-stroke-cycle spark-ignition engine. This deteriorates the ignitability of the air-fuel mixture charged in the cylinder and makes it impossible for a two-stroke-cycle spark-ignition engine to be operated with an air-fuel mixture as thin as that used in four-stroke-cycle spark-ignition engines. Thus, misfire readily occurs unless a particularly powerful spark is used for ignition. Finding a solution to this problem is difficult because it is associated with the scavenging method employed.

Furthermore, the conventional two-stroke-cycle spark-ignition engine has essential disadvantages that it consumes a relatively large amount of lubricant, that the exhaust gas contains larger amounts of hydrocarbons and carbon monoxide due to the problems involving scavenging and combustion, and that the exhaust gas is smelly and accompanied by smother due to the fact that lubricant is readily mixed with the air-fuel mixture in the cylinder.

Although the conventional two-stroke-cycle spark-ignition engine generally has a slightly better engine performance, is simple and small in size, and can be manufactured at a lower cost than a four-stroke-cycle spark-ignition engine of the same displacement, it suffers from the problems that it consumes larger amounts of fuel and lubricant, that the exhaust gas is a pollutant, and that it generates vibrations and noise due to its lack of stability and smoothness of operation.

These factors limit the use of the existing two-stroke-cycle spark-ignition engine to special applications, including small portable industrial machines, small motor bicycles and motor boats, and excluding applications that require more power, such as automobiles, and those that require a low level of noise such as vehicles for use on public roads.

SUMMARY OF THE INVENTION

Accordingly, an object of the present invention is to provide a two-stroke-cycle uniflow spark-ignition engine in which the problems or drawbacks of the above-described conventional two-stroke-cycle spark-ignition engine are eliminated without losing the merits of the two-stroke-cycle spark-ignition engine.

To this end, the present invention provides a two-stroke-cycle uniflow spark-ignition engine which generates power by pressurizing the fluid introduced into a crank chamber within the crank chamber with a piston as it moves toward its bottom dead center, feeding the pressurized fluid to an annular scavenging chamber provided on the entire periphery of the cylinder where it accumulates, discharging the fluid in the annular scavenging chamber from a plurality of scavenging ports that are opened at the end of the descending stroke of the piston into a cylinder chamber provided above the piston as a scavenging fluid in the form of a swirling uniflow, compressing the air-fuel mixture in the cylinder with the piston as it moves to its top dead center, igniting it with an ignition plug to provide combustion, and exhausting the resultant burned exhaust gas through an exhaust valve provided in a cylinder head which opens at the end of the descending stroke of the piston caused by the expansion of the combustion gas.

In the two-stroke-cycle uniflow spark ignition engine according to the present invention, power is generated as follows: The fluid introduced into the crank chamber is compressed by the piston as it moves to its bottom dead center and the compressed fluid is fed into the annular scavenging chamber where it accumulates. The pressurized fluid in this annular scavenging chamber is discharged into the cylinder chamber from the scavenging ports in the form of a swirling scavenging fluid, and the discharged fluid is compressed by the piston as it moves to its top dead center and is then ignited by the ignition plug and undergoes combustion. In consequence, the engine power is increased, the specific fuel consumption is reduced, and the properties of the exhaust gas are greatly improved. These factors enable provision of a new type of prime mover which may be used as a reliable engine in wide applications including various types industrial machines and transportation machines.

Another object of the present invention is to provide a two-stroke-cycle uniflow spark-ignition engine which enables an air-fuel mixture to be employed as a scavenging fluid.

Still another object of the present invention is to provide a two-stroke-cycle uniflow spark-ignition engine which enables air to be employed as a scavenging fluid and which allows a fuel to self-collide at a point in the cylinder chamber.

DESCRIPTION OF THE PREFERRED EMBODIMENTS

Figure 1:
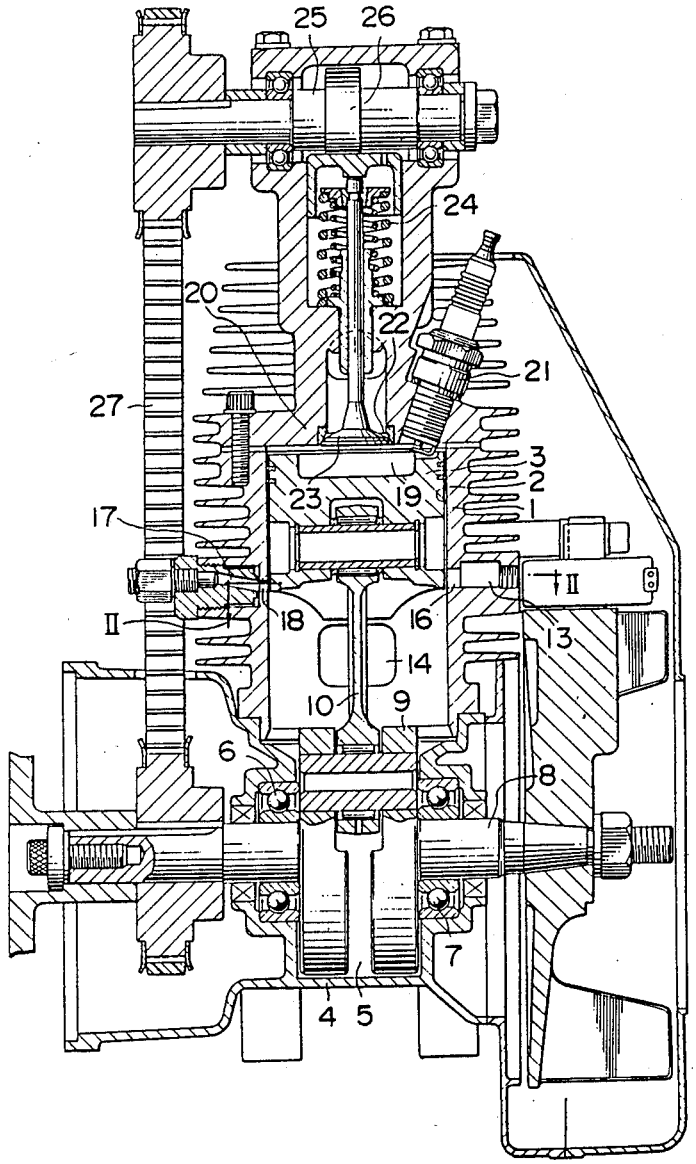
FIG. 1 is a vertical cross-sectional view of a two stroke-cycle uniflow spark-ignition engine, showing a first embodiment of the present invention.

A first embodiment of the present invention will be described below with reference to FIGS. 1 to 4.

The two-stroke-cycle uniflow spark-ignition engine includes a cylinder 1, a piston 3 reciprocatively provided within a cylinder chamber 2 of the cylinder 1, and a crankcase 4 provided below the cylinder 1. The crankcase 4 defines a hermetically sealed crank chamber 5. The lower end portion of the cylinder chamber 2 is made to communicate with the upper end portion of the crankcase 4. A crank shaft 8 is rotatably supported by the crankcase 4 through bearings 6 and 7. The crank shaft 8 is coupled to the piston 3 through a connecting rod 10 at a crank 9. The crank chamber 5 has an internal volume which is just enough to allow for the rotation of the crank 9 and the motion of the connecting rod 10. Also, it is arranged so that the fluid present in the crank chamber 5 can be pressurized by the piston as it moves toward its bottom dead center. The crankcase 4 may be provided with an inlet port (not shown) with a reed valve incorporated therein. The seed valve allows the inlet port to open and close by virtue of a vacuum generated within the crank chamber 5 to introduce only the air into the crank chamber 5. A rotary valve (not shown) of the type which is driven together with the crank shaft 8 may be provided in place of the reed valve. Alternatively, an intake port may be formed in the lower portion of the side wall of the cylinder 1 so as to introduce a fluid into the crank chamber 5, the intake port being opened and closed by the piston 3 which moves reciprocatively, by means of which supply of the fluid into the crank chamber 5 is controlled.

Figure 2:
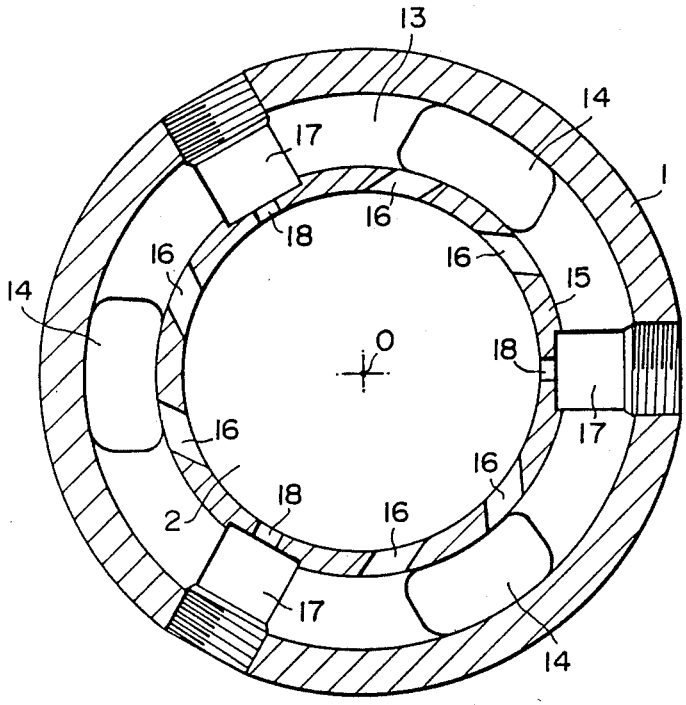
FIG. 2 is a section taken along the line II—II of FIG. 1.
Figure 3:
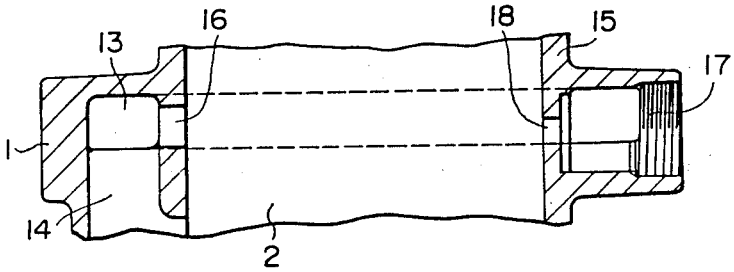
FIG. 3 is a vertical cross-sectional view of a cylinder portion of FIG. 2.
Figure 4:
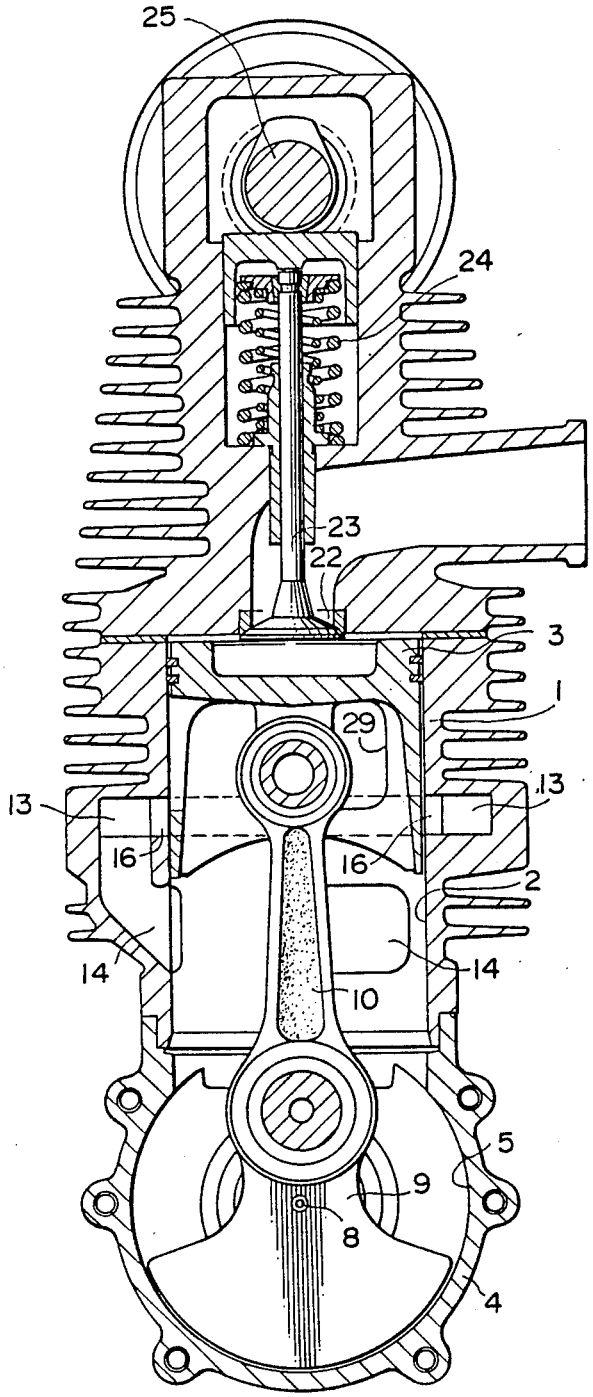
FIG. 4 is a vertical cross-sectional view of the two-stroke-cycle uniflow spark-ignition engine taken along the vertical plane perpendicular to the section of FIG. 1.

The cylinder 1 has an annular scavenging chamber 13 formed in its side wall on the entire periphery thereof. The annular scavenging chamber 13 communicates with the crank chamber 5 through a plurality of scavenging passages 14 formed below it at equiangular positions (the present embodiment has three of it, as shown in FIG. 2) so that the pressurized air in the crank chamber 5 is introduced into the annular scavenging chamber 13 as a scavenging fluid and accumulates therein. The scavenging fluid may be introduced into the scavenging passages 14 through scavenging windows 29 (see FIG. 4) in the piston, as in the case of a conventional scavenging system. The annular scavenging chamber 13 communicates with the interior of the cylinder chamber 2 through a plurality of scavenging ports 16 (this embodiment has six of it) which may be formed in an inner wall portion 15 (see FIG. 2) of the cylinder 1. The scavenging ports 16 are formed along a plane perpendicular to the central axis 0 of the cylinder 1 (see FIG. 3). Alternatively, they may be formed along a slightly conical surface with respect to the central axis 0. Further, each of the scavenging ports 16 is formed so that the center of the end portion thereof is inclined in one direction at about 45 degrees with respect to the radial line that passes through the central axis 0 of the cylinder 1 (see FIG. 2). This arrangement allows the scavenging fluid to be discharged into the cylinder chamber 2 from the annular scavenging chamber 13 through the individual scavenging ports 16 in the form of a swirling flow that rotates horizontally in the cylinder chamber 2. Alternatively, the scavenging ports 13 may be arranged so that they are divided into some groups and so that these scavenging ports are inclined at some different angles so as to generate a desired flow of scavenging fluid that swirls within the cylinder chamber 2.

A plurality of fuel injection nozzles 17 (three of it in the case of this embodiment) are provided in the cylinder chamber 2 at equiangular positions in the circumferential direction. Injection ports 18 for fuel injection nozzles 17 that are formed in the cylinder inner wall portion 15 are directed to the interior of the cylinder chamber 2 so that the fuel is injected toward one point on the central axis 0 of the cylinder chamber 2. This allows the fuel injected into the cylinder chamber 2 from the individual injection port 18 to self-collide and be atomized in the vicinity of the central axis 0 of the cylinder chamber 2, the atomized fuel being mixed with the air that is swirling in the cylinder chamber 2 after it has been discharged thereinto from the scavenging ports 16. If the fuel injection nozzles 17 employed are of the type which requires compressed air (air injection type), they may be made to communicate with the crank chamber 5 so that part of the compressed air in the crank chamber 5 is supplied thereto. Compressed air may also be supplied to the fuel injection nozzles 17 from an air pump which associates with the engine.

Solid injection type of fuel injection nozzles 17 may also be employed.

The piston 3 may be of the type which is normally employed in the conventional two-stroke-cycle spark-ignition engine. In this embodiment, however, the top portion of the piston 3 is provided with a recess 19 that forms a proper air-fuel mixture zone. Further, the scavenging windows 29 may be provided in opposed relation with the scavenging passages 14 so as to cool the piston.

An ignition plug 21 is provided on a cylinder head 20, i.e., at the top portion of the cylinder 1. The ignition plug 21 is connected to an ignition system (not shown), and operates when the piston 3 reaches the vicinity of the top dead center thereof so as to ignite the compressed air-fuel mixture within the cylinder chamber 2 for combustion.

The top portion of the cylinder 1 is provided with an exhaust port 22, which is opened and closed by an exhaust valve 23. The exhaust valve 23 may be of poppet type which is generally employed in the four-stroke-cycle spark-ignition engine. It is brought into contact with a cam surface 26 of a camshaft 25 by means of a spring 24. The camshaft 25 is coupled to the crank shaft 8 through a toothed timing belt 27 so that it is driven at the same rotational speed as that of the crank shaft 8, and this allows the exhaust valve 23 to be opened and closed at predetermined time intervals so as to discharge the burned exhaust gas within the cylinder chamber 2 to the outside thereof. The exhaust valve 23 is operated in the same manner as that employed in the OHV (over head valve) OHC (over head cam shaft) type for the conventional four-stroke-cycle spark-ignition engine. If the exhaust valve 23 is the one which is provided on the side of the cylinder, it is operated in the same manner as that employed in the SV (side valve) type.

In this embodiment, a secondary air supplying device for supplying suitable secondary air into the cylinder chamber 2 may be provided in the cylinder 1, if necessary.

Figure 5:
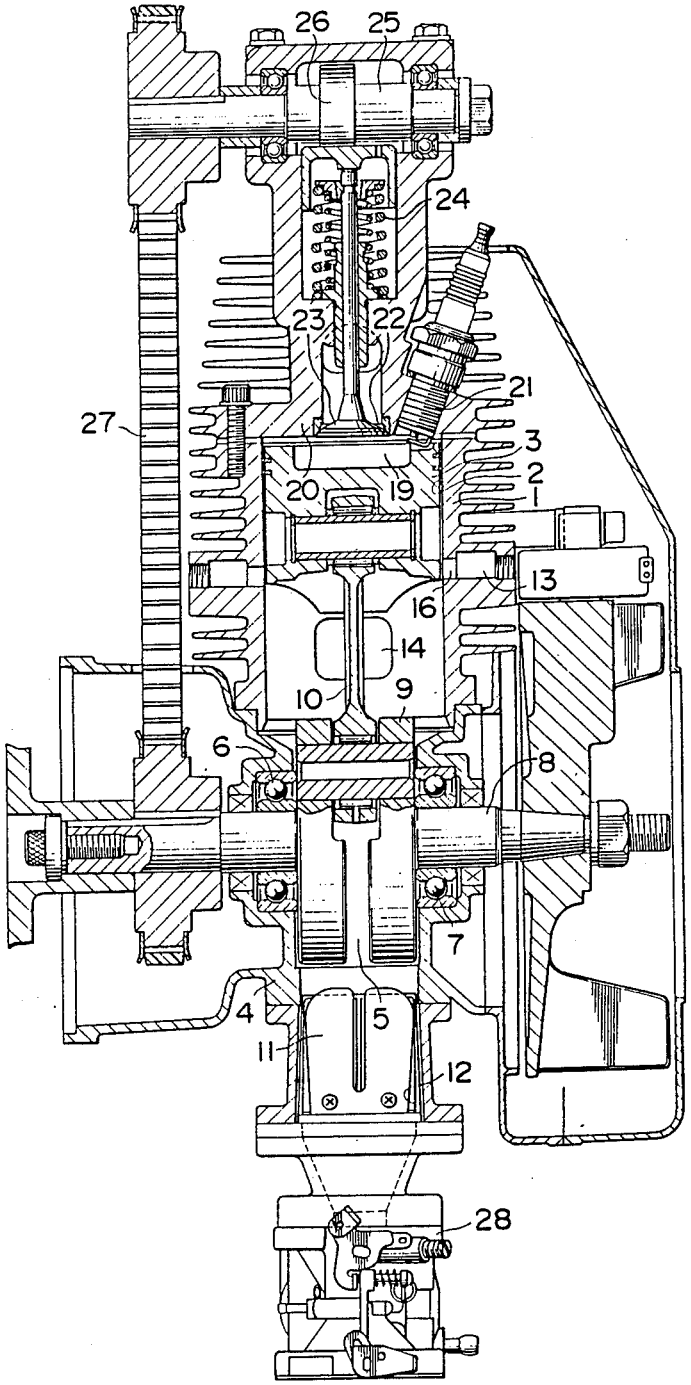
FIG. 5 is a vertical cross-sectional view of a two-stroke-cycle uniflow spark-ignition engine, showing a second embodiment of the present invention.

FIG. 5 shows a second embodiment of the present invention. In this embodiment, an inlet port 12 of the crank chamber 5 is copuled to a carbureter 28, and an air-fuel mixture is introduced from the carbureter 28 into the crank chamber 5, the air-fuel mixture is introduced being precompressed within the crank chamber 5 and the compressed mixture being introduced into the annular scavenging chamber 13 through the scavenging passages 14 as the scavenging fluid which is to be discharged into the cylinder chamber 2 from the scavenging ports 16 where it is ignited by a spark generated by the ignition plug 21 within the cylinder chamber 2 for combustion. Other structures of this embodiment are the same as those of the first embodiment shown in FIG. 1.

As regards lubrication, the above-described embodiments can adopt either the so-called mixed oil lubrication system which is generally used in the conventional two-stroke-cycle spark-ignition engine in which fuel is mixed with a lubricant beforehand and is supplied to the engine, or the so-called separate oil lubrication system in which only a lubricant is directly supplied to the engine from a pump device or in which a lubricant is introduced to the inlet port where it is mixed with the air or air-fuel mixture. However, adoption of the separate oil lubrication system is preferable from the viewpoint of purification of the exhaust gas.

Figure 6:
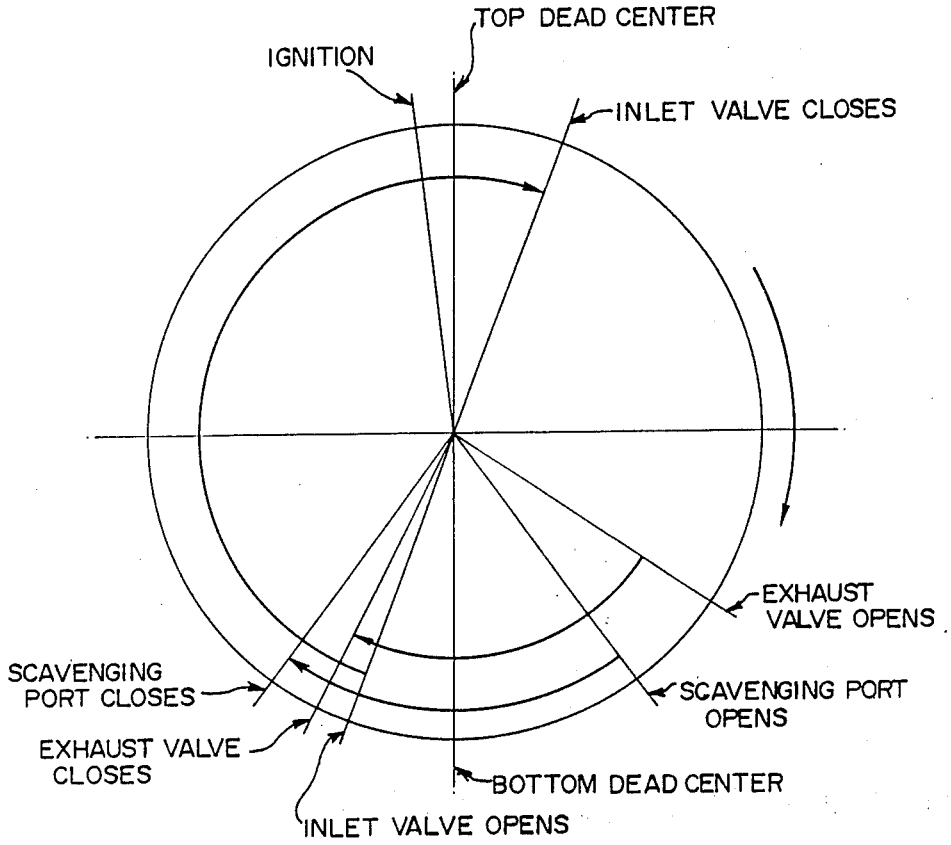
FIG. 6 is a valve timing diagram of an engine according to the present invention which is indicated by crank angle.

FIG. 6 is a valve timing diagram of a single cylinder two-stroke-cycle uniflow spark-ignition engine which is adopted in the above-described embodiments of the present invention, which is illustrated using the crank angle.

The two-stroke-cycle spark ignition engine according to the present invention may also be constructed as a multi cylinder engine which is generally carried out as the conventional two-stroke-cycle spark-ignition engines. Further, as regards cooling, both of the air cooling system and the liquid cooling system can be adopted in the two-stroke-cycle spark-ignition engine according to the present invention. Furthermore, the present invention can be applied to engines having large displacements which are common among the existing four-stroke-cycle spark-ignition engines.

What is claimed is:

1. A two-stroke-cycle uniflow spark-ignition engine which generates power by pressurizing fluid introduced into a crank chamber within said crank chamber with a piston as it moves toward its bottom dead center position, feeding the pressurized fluid to an annular scavenging chamber extending around the entire periphery of a cylinder where it accumulates, discharging the fluid in said annular scavenging chamber into a combustion chamber within the cylinder above said piston through a plurality of scavenging ports opened near the end of the descending stroke of said piston, each of which ports is shaped to direct the scavenging fluid at an angle to the radial line joining the center of the port and the central axis of the cylinder so that the scavenging fluid enters the combustion chamber as a swirling uniflow, igniting with a spark plug an air-fuel mixture which has been compressed within said combustion chamber by said piston as it moves to its top dead center to provide combustion, and exhausting the resultant burnt exhaust gas through an exhaust valve in a cylinder head, said exhaust valve being opened near the end of the descending stroke of said piston caused by the expansion of the combustion gas, and in advance of the opening of the scavenging ports.

2. A two-stroke-cycle uniflow spark ignition engine according to claim 1, wherein said scavenging fluid which is pressurized in said crank chamber, is fed to said annular scavenging chamber, and is discharged into said cylinder chamber from said scavenging ports, is an air-fuel mixture.

3. A two-stroke-cycle uniflow spark ignition engine according to claim 1, wherein said scavenging fluid which is pressurized in said crank chamber, is fed to said annular scavenging chamber, and is discharged into said cylinder chamber from said scavenging ports, is an air, said cylinder is provided with a plurality of fuel injection nozzles for injecting fuel into said cylinder chamber in the vicinity of the bottom dead center point of said piston, and the fuel injected from said fuel injection nozzles self-collides at a point in said cylinder chamber.

* * * * *